US007861610B2

(12) United States Patent
Dewert

(10) Patent No.: US 7,861,610 B2
(45) Date of Patent: Jan. 4, 2011

(54) ADJUSTABLE SEATING FURNITURE

(75) Inventor: Eckhart Dewert, Zürich (CH)

(73) Assignee: Linrot Holding AG, Zürich (CH)

( * ) Notice: Subject to any disclaimer, the term of this patent is extended or adjusted under 35 U.S.C. 154(b) by 800 days.

(21) Appl. No.: 11/826,537

(22) Filed: Jul. 16, 2007

(65) Prior Publication Data

US 2008/0012395 A1 Jan. 17, 2008

Related U.S. Application Data

(63) Continuation of application No. PCT/EP2005/010534, filed on Sep. 29, 2005.

(30) Foreign Application Priority Data

Jan. 14, 2005 (EP) ..... PCT/EP2005/000302

(51) Int. Cl.
*F16H 21/18* (2006.01)

(52) U.S. Cl. ..... 74/45; 297/362.14; 297/362.11

(58) Field of Classification Search ..... 297/362.14, 297/326.11; 74/89.23, 45
See application file for complete search history.

(56) References Cited

U.S. PATENT DOCUMENTS

| | | | | |
|---|---|---|---|---|
| 2,809,688 | A * | 10/1957 | Brundage | 248/419 |
| 3,874,245 | A * | 4/1975 | Kral et al. | 74/89.33 |
| 4,258,445 | A | 3/1981 | Zur | |
| 5,075,911 | A | 12/1991 | Dewert | |
| 6,961,971 | B2 | 11/2005 | Schneider | |
| 7,198,325 | B2 | 4/2007 | Dewert | |
| 7,681,864 | B2 * | 3/2010 | O'Shea | 251/288 |
| 2005/0120481 | A1 | 6/2005 | Farmont | |

(Continued)

FOREIGN PATENT DOCUMENTS

| | | |
|---|---|---|
| CH | 615 333 | 1/1980 |

(Continued)

OTHER PUBLICATIONS

PCT Schriftlicher Bescheid der Internationalen Recherchenbehorde (Regel 43*bis*.1 PCT) in PCT/EP2005/010534, filed Sep. 29, 2005 (3 pp.).

(Continued)

*Primary Examiner*—Richard W Ridley
*Assistant Examiner*—Terence Boes
(74) *Attorney, Agent, or Firm*—Shlesinger, Arkwright & Garvey LLP

(57) ABSTRACT

Furniture drive for displacing parts of a piece of furniture relative to one another, includes a linearly displaceable drive element for pivoting a pivot shaft that, when furniture drive is in a mounted position, is operatively connected to a part of the piece of furniture to be displaced, and drive element is connected in the manner of a crank mechanism via a rod-like power transmission element to pivot shaft, one end of which is connected to drive element in an articulated manner, however without displacing in the longitudinal direction of power transmission element, and other end of which is connected in an articulated manner to a crank pin of pivot shaft, the position and distance of coupling points of power transmission element on drive element and pivot shaft being selected such that power transmission element, during displacing movement, changes the angular position by more than 20°, preferably more than 40°.

9 Claims, 3 Drawing Sheets

U.S. PATENT DOCUMENTS

| | | | |
|---|---|---|---|
| 2006/0130236 | A1 | 6/2006 | Dewert |
| 2006/0253984 | A1 | 11/2006 | Dewert |
| 2007/0220677 | A1 | 9/2007 | Dewert |
| 2008/0012404 | A1 | 1/2008 | Dewert |
| 2008/0012405 | A1 | 1/2008 | Dewert |
| 2008/0012414 | A1 | 1/2008 | Dewert |
| 2008/0018157 | A1 | 1/2008 | Dewert |

FOREIGN PATENT DOCUMENTS

| | | | |
|---|---|---|---|
| DE | 199 03 112 | A1 | 10/2000 |
| DE | 101 48 270 | C1 | 2/2003 |
| EP | 1 378 189 | A1 | 1/2004 |
| EP | 1 477 086 | A1 | 11/2004 |
| FR | 2 730 146 | | 8/1996 |
| WO | 2004/026082 | | 4/2004 |

OTHER PUBLICATIONS

International Search Report dated Jan. 13, 2006 in PCT/EP2005/010534, filed Sep. 29, 2005 (3 pp.).
U.S. Appl. No. 11/030,949, filed Jan. 2005.
U.S. Appl. No. 11/170,091, filed Jun. 2005.
U.S. Appl. No. 11/293,494, filed Dec. 2005.
U.S. Appl. No. 11/293,498, filed Dec. 2005.
U.S. Appl. No. 11/486,068, filed Jul. 2006.

* cited by examiner

ADJUSTABLE SEATING FURNITURE

CROSS-REFERENCE TO RELATED APPLICATIONS

This application is a continuation of application no. PCT/EP2005/010534, filed Sep. 29, 2005, which claims the priority of PCT application no. PCT/EP2005/000302, filed Jan. 14, 2005, and each of which is incorporated herein by reference.

FIELD OF THE INVENTION

The invention relates to a furniture drive of the type mentioned configured for displacing parts of a piece of furniture relative to one another. More particularly, the invention relates to a furniture drive for displacing parts of a piece of furniture relative to one another, and including a drive element, which can be linearly displaced along a linear axis of motion, for pivoting a pivot shaft that, when the furniture drive is in a mounted position, is operatively connected to a part of the piece of furniture to be displaced.

BACKGROUND OF THE INVENTION

Furniture drives of this type serve, for example, for the adjustment of parts of armchairs and are known, for example, from DE 101 48 270 C1, DE 100 17 978 C1, DE 100 17 979 C1, DE 100 31 737 A1, EP 1 294 255 A1, DE 100 46 750 C1, EP 1 318 737 A, DE 100 46 752 C1, EP 1 318 738 A1, EP 1 276 406 A1, EP 1 416 832 A1, DE 101 57 650 C1, WO 03/045195 A1, EP 0 372 032 B1, DE 38 42 078 C2, EP 0 583 660 B1, DE 296 07 493 U1, DE 197 18 255 C1, WO 99/27819, DE 296 03 173 U1, DE 296 12 493 U1, DE 190 08 083 C1 and DE 87 11 567 U1. The known furniture drives comprise, for example, a drive element, which can be linearly displaced in order to pivot a pivot shaft that, when the furniture drive is in a mounted position, is operatively connected to a part of the piece of furniture to be displaced. The pivot shaft may be part of a fitting of a piece of furniture. From DE 10 2004 01 648 A1, a furniture drive of this type is known for displacing parts of a piece of furniture relative to one another, the drive comprising a linearly displaceable drive element in the form of a spindle nut for pivoting a pivot shaft that, when the furniture drive is in a mounted position, is operatively connected to a part of the piece of furniture to be displaced. In the known furniture drive, the pivot shaft is connected together with the spindle nut via a joining lug with a hook-like end, by which the shaft is engaged in a journal of the spindle nut. So as to hold the joining element with the spindle nut in engagement, a spring mechanism is provided, which biases the joining element against the journal on the spindle nut.

OBJECTS AND SUMMARY OF THE INVENTION

It is therefore an object of the invention to provide a furniture drive simpler and more compact than in the prior art.

It is another object of the invention to provide a furniture drive of the type configured for displacing parts of a piece of furniture relative to one another, and including a drive element, which can be linearly displaced along a linear axis of motion, for pivoting a pivot shaft that, when the furniture drive is in a mounted position, is operatively connected to a part of the piece of furniture to be displaced, and which drive is simple and compact.

This object is achieved with the teaching according to the invention of a furniture drive for displacing parts of a piece of furniture relative to one another, and including a drive element, which can be linearly displaced along a linear axis of motion, for pivoting a pivot shaft that, when the furniture drive is in a mounted position, is operatively connected to a part of the piece of furniture to be displaced.

According to the invention, the drive element, which may be formed, for example and in particular, by a spindle nut of a spindle drive, can be connected in the manner of a crank mechanism via a rod-like power transmission element to the pivot shaft, wherein one end of the power transmission element is connected to the drive element in an articulated manner, however without displacing in the longitudinal direction of the power transmission element, and the other end is connected to a crank pin of the pivot shaft in an articulated manner. In this way, a particularly simple as well as cost-efficient and robust design is implemented, wherein, for example and in particular, the power transmission element may be permanently connected to the pivot shaft and the drive element, thus eliminating complex mechanisms, which are necessary if the drive element acts upon the pivot shaft only loosely, for example to facilitate the detaching of the furniture drive from a fitting of the piece of furniture.

According to the invention, the pivot shaft is therefore configured as a crank and is driven by a pivot drive via the drive element and the power transmission element in the manner of a crank mechanism. The furniture drive according to the invention differs from a true crank mechanism in that the crank does not rotate, but pivots back and forth by a defined pivot angle as the drive element performs linear back and forth movements. In keeping with the operating principle of a crank mechanism, the power transmission element performs an angular movement when the pivot shaft is pivoted, wherein according to the invention the position and distance of the coupling points of the power transmission element on the drive element and on the pivot shaft are selected such that the power transmission element during the displacing movement changes its angular position by more than 20°, preferably by more than 40°. In this way, particularly advantageous kinematics of the movement of the power transmission element are achieved, achieving a large pivot stroke of the pivot shaft with a relatively small movement stroke of the drive element. Due to the relatively low linear stroke of the drive element, the furniture drive according to the invention may have a particularly compact configuration in the direction of the linear axis of motion.

For example and in particular, in a first end position of the displacement movement, the longitudinal axis of the power transmission element extending through the pivot axes of the connections to the drive element or the pivot shaft, together with the linear axis of motion of the drive element, may form an angle of more than 40°, for example approximately 60°, while the longitudinal axis in an end position of the displacing movement can be substantially parallel to the linear axis of motion. In this way, particularly advantageous kinematics are created.

In keeping with the operating principle of a crank mechanism, the crank pin of the pivot shaft is disposed eccentrically to the pivot axis.

An advantageous further development of the invention provides that the power transmission element has a guide extending in the longitudinal direction, in or on which the crank pin of the pivot axis is guided. This creates a freewheel in the event that the part of the piece of furniture to be displaced by means of the furniture drive is displaced manually from the starting position in the direction of the end position of the displacing movement. In this way, damage to the furniture drive is reliably avoided.

One advantageous further development of the above embodiment provides that the guide is formed by a slot. In this embodiment, the guide may be provided particularly easily and cost-efficiently on the power transmission element.

Another advantageous further development of the invention provides that the drive element pulls the crank pin during the displacing movement. As a result, the power transmission element is subjected to tension during the displacing movement, which is to say under load. Consequently, the power transmission element may be dimensioned weaker than would be required if it were subjected to pressure, in which case the power transmission element would have to be dimensioned strong enough to prevent buckling.

An extraordinarily advantageous further development of the invention provides that the pivot shaft has an axial recess with an irregular cross-section so as to receive a shaft of a displacing fitting in a substantially non-rotatable manner, the shaft having a cross-section that is substantially complementary to the cross-section of the recess. In this embodiment, the shaft of the displacing fitting can be inserted, for example, in the recess, thus facilitating a joining of the furniture drive to the shaft or a detaching from the shaft. In this embodiment, assembly or disassembly of the furniture drive to or from a piece of furniture is facilitated, despite the preferably non-detachable connection between the drive element, the power transmission element and the pivot axis.

So as to design the kinematics of the inventive furniture drive as advantageously as possible, further developments of the teaching according to the invention provide that in a first end position of the displacing movement the longitudinal axis of the power transmission element, together with the linear axis of motion of the drive element, encloses an angle of more than 45° and/or that in a second end position the longitudinal axis of the power transmission element is substantially parallel to the linear axis of motion of the drive element. Particularly by combining the two characteristics, particularly advantageous kinematics can be achieved, which enable a particularly large displacing stroke with a particularly small axial moving stroke of the drive element.

So as to design the configuration in a particularly simple and cost-efficient manner, a further development of the invention provides that the drive element, which can be linearly displaced, is a spindle nut of a spindle drive, which is disposed non-rotatably and displaceably in the axial direction on a threaded spindle, which can be rotationally driven by means of an electric motor.

The invention will be explained in more detail hereinafter with reference to the figures schematically illustrated in the drawings, showing one exemplary embodiment of an inventive furniture drive. All described or illustrated characteristics as well as those claimed in the claims, either alone or in any combination, represent the subject matter of the invention, regardless of the summary in the claims, or to what claim they refer, as well as regardless of their formulation and/or illustration in the description and/or figures.

Relative terms, such as left, right, up, and down, are for convenience only, and are not intended to be limiting.

DETAILED DESCRIPTION OF THE INVENTION

Figure 1:
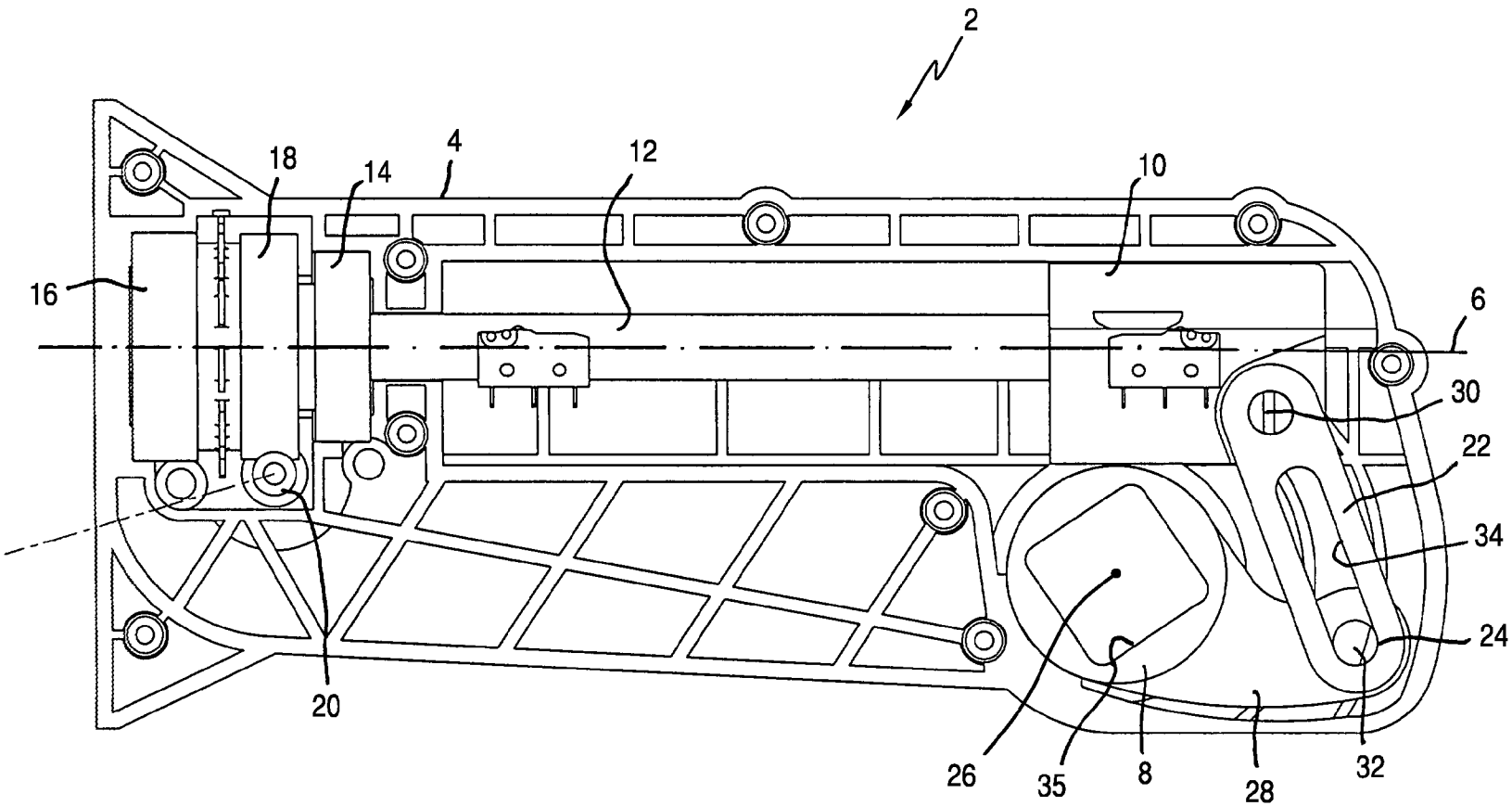
FIG. 1 is a schematic side view of one exemplary embodiment of a furniture drive according to the invention in a first end position of the displacing movement.

FIG. 1 shows one exemplary embodiment of an inventive furniture drive 2, which includes a housing 4 with halfshells that can be connected to one another, of which one halfshell has been removed in FIG. 1 for clarity reasons. The furniture drive 2 serves to displace parts of an unillustrated piece of furniture, for example an armchair, relative to one another. Along a linear axis of motion, which is symbolized by a dash-dotted line 6 in FIG. 1, it has a drive element, which can be linearly displaced, for pivoting a pivot shaft 8 that, when the furniture drive is in a mounted position, is operatively connected to a part of the piece of furniture to be displaced. In this exemplary embodiment, the drive element is formed by a spindle nut 10 of a spindle drive, the nut being non-rotatably guided in the housing 4 and disposed displaceably in the axial direction on a threaded spindle 12 that can be rotatably driven. The threaded spindle 12 is mounted rotatably on the inside of the housing 4 via ball bearings 14, 16 and is non-rotatably connected to a worm gear 18, which is engaged with a worm 20, which is non-rotatably connected to the output shaft of an electric motor, which is not shown, or is integrally formed thereon. In this way, the threaded spindle 12 has a rotatable drive connection with the electric motor, which is not shown, so that the spindle nut 10 turns to the left or right of the drawing, in accordance with the direction of rotation of the threaded spindle 12.

According to the invention, the spindle nut 10 is connected in the manner of a crank mechanism via a rod-like power transmission element 22 to the pivot shaft 8, wherein one end of the power transmission element 22 is connected to the spindle nut 10 in an articulated manner, however without displacing in the longitudinal direction of the power transmission element 22. The other end of the power transmission element 22 is connected in an articulated manner to a crank pin 24, which is disposed eccentrically to a pivot axis 26 of the pivot shaft 8 on a pivot lever 28, which is non-rotatably connected to the pivot shaft 8. The pivot lever 28 forms the crank of the crank mechanism.

Figure 2:
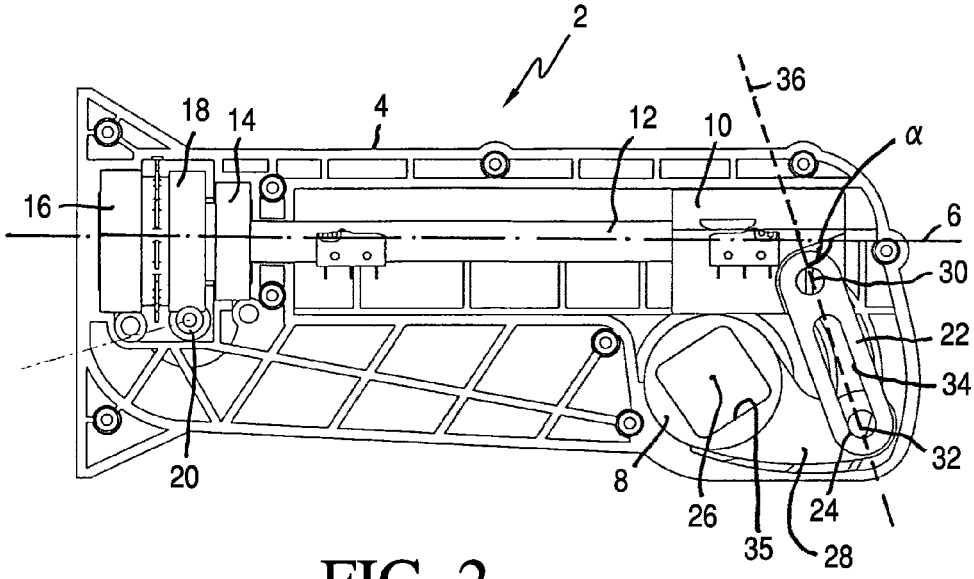
FIG. 2 shows the same view of the furniture drive as FIG. 1, however on a reduced scale as compared with FIG. 1.
Figure 3:
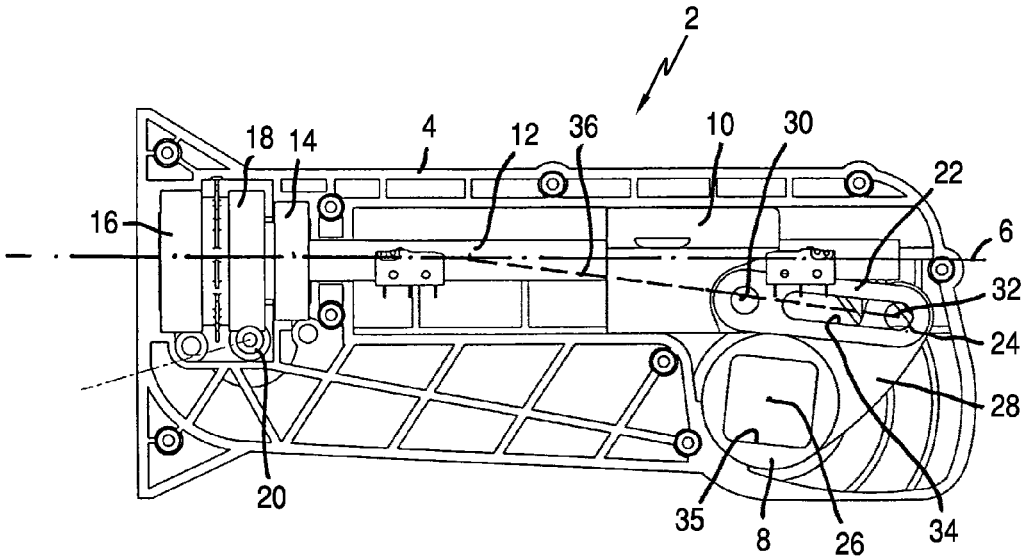
FIG. 3 shows the same view as FIG. 2 of the furniture drive according to FIG. 2 in a displaced position between the end positions of the displacing movement.
Figure 4:
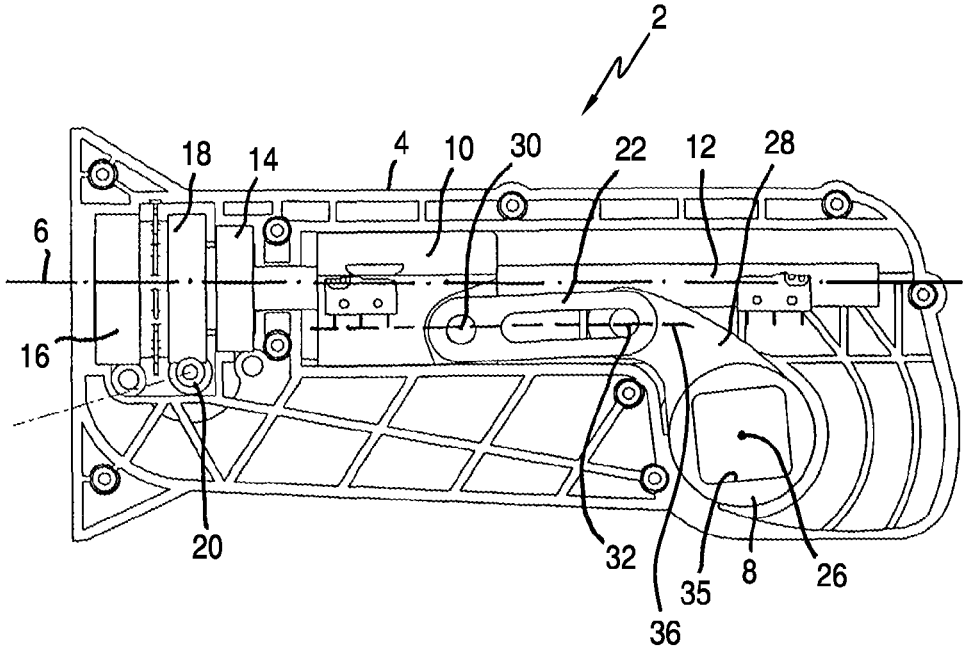
FIG. 4 shows the same view as FIG. 2 of the furniture drive according to FIG. 2 in a second end position of the displacing movement.

As a result of the articulated connection of the power transmission element 22 to the spindle nut 10 on the one hand and the pivot lever 28 and hence the pivot shaft 8 on the other hand, coupling points 30, 32 of the power transmission element 22 are defined on the spindle nut 10 or the pivot axis 26, the position and distance of these points in relation to one another being selected according to the invention such that the power transmission element, during the displacing movement, changes the angular position by more than 20°, preferably by more than 40°, as will be explained in more detail below with reference to FIGS. 2 to 4.

In principle, the power transmission element 22 may also be connected to the crank pin 24 in an articulated manner, however without displacing in the longitudinal direction to the pivot shaft 8. In the example illustrated in the drawing, the power transmission element 22, however, has a guide extending in the longitudinal direction in the form of a slot 34, in which the crank pin 24 is displaceably guided.

In this exemplary embodiment, the pivot shaft 8 has an axial recess 35 with an irregular cross-section, in which a fitting of the piece of furniture to be displaced can be inserted, the fitting not being illustrated, wherein the shaft has a cross-section that is substantially complementary to the cross-section of the recess 35, so that in this way the shaft of the fitting is connected substantially non-rotatably to the pivot shaft 8.

FIG. 2 shows the furniture drive 2 in a first displacing position, in which the longitudinal axis of the power transmission element 22 extending through the connecting points 30, 32 and symbolized by a dotted line 36 according to FIG. 2, together with the linear axis of motion 6 of the spindle nut 10 encloses an angle $\alpha$ of more than 45°, in the illustrated example namely an angle of approximately 70°.

So as to pivot a part of a piece of furniture to be displaced by means of the furniture drive 2, the pivot shaft 8 is pivoted. For this purpose, the electric motor drives the threaded spindle 12 such that the spindle nut 10 is displaced to the left in FIG. 2.

As is shown in FIG. 3, the pivot shaft 8 in FIG. 3 is pivoted counterclockwise in the manner of a crank mechanism by the power transmission element 22, wherein in keeping with the function of a crank mechanism the power transmission element 22 changes the angular position, as is illustrated in FIG. 3. When pivoting the pivot shaft 8, for example, one shaft of a fitting of the piece of furniture to be displaced is pivoted, the shaft being operatively connected to a part of the piece of furniture to be displaced. As FIG. 2 shows, during the displacing movement, which is to say under load, the power transmission element 22 pulls the crank pin 24, so that the element is subjected to tension during the displacing movement.

In a further movement of the spindle nut 10 according to FIG. 3 to the left, the pivot shaft 8 is pivoted further in FIG. 3 counterclockwise until the second end position of the displacing movement shown in FIG. 4 has been reached.

As is apparent from FIG. 4, in this second end position the longitudinal axis 36 of the power transmission element 22 is substantially parallel to the linear axis of motion of the spindle nut 10.

As is apparent from a comparison of FIG. 2 with FIG. 4, the power transmission element 22 has changed the angular position by approximately 70° between the first end position shown in FIG. 2 and the second end position of the displacing movement shown in FIG. 4. A comparison of FIG. 2 with FIG. 4 furthermore shows that, as a result of the crank mechanism-like connection of the spindle nut 10 to the pivot shaft 8, the furniture drive 2 according to the invention enables a large displacing stroke of the pivot shaft 8 about the pivot axis 26 with a relatively small linear displacing stroke of the spindle nut 10.

If a part of the piece of furniture to be displaced, starting from the first end position of the displacing movement shown in FIG. 2, is displaced manually by a user in the displacing direction, the pivot shaft 8 is rotated about the pivot axis 26. The crank pin 24 glides in the slot 34 of the power transmission element 22, wherein the power transmission element 22 is pivoted about the connecting point 30 and changes the angular position. In this way, a freewheel is created in the illustrated exemplary embodiment, the freewheel enabling manual displacement of the part of the piece of furniture to be displaced across a defined displacing range, wherein the part of the piece of furniture is not locked in the respective displacing position, as is the case with a motor-driven displacement, by means of the furniture drive 2.

As a result of the permanent connection of the spindle nut 10 to the pivot shaft 8 via the power transmission element 22, the furniture drive 2 has a particularly simple configuration and is therefore cost-efficient to produce and also particularly robust.

The furniture drive 2 according to the invention is suited to displace any desired parts of furniture. According to the invention, while maintaining the basic inventive principle of a crank mechanism-like connection of the drive element to the pivot shaft, the position and distance of the connecting points of the power transmission element to the drive element or the pivot shaft can also be selected such that, during the displacing movement, the power transmission element changes the angular position by less than 20°.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A furniture drive for displacing parts of a piece of furniture relative to one another, comprising:

a) a drive element;

b) a pivot shaft;

c) the drive element being linearly displaceable along a linear axis of motion, for pivoting the pivot shaft, in use, when the furniture drive is in a mounted position on a piece of furniture, and is operatively connected to a part of the piece of furniture to be displaced;

d) the drive element being connected in the manner of a crank mechanism via a rod-shaped power transmission element to the pivot shaft, and one end of which is connected to the drive element in an articulated manner, and the other end of which is connected in an articulated manner to a crank pin of the pivot shaft, a position and distance of the coupling points of the power transmission element on the drive element and the pivot shaft being selected such that the power transmission element, during displacing movement, in use, changes its angular position by more than 20°;

e) the power transmission element including a guide having a slot extending in a longitudinal direction, and the crank pin of the pivot shaft being displaceably guided along the slot; and the slot being configured for guiding the crank pin when manually displacing one of the parts of the piece of furniture relative to another.

2. A furniture drive according to claim 1, wherein:

a) the drive element pulls the crank pin during the displacing movement.

3. A furniture drive according to claim 1, wherein:

a) the pivot shaft has an axial recess with an irregular cross-section so as to receive a shaft of a displacing fitting in a substantially non-rotatable manner, the shaft having a cross-section that is substantially complementary to the cross-section of the axial recess.

4. A furniture drive according to claim 1, wherein:

a) in a first end position of displacing movement, a longitudinal axis of the power transmission element, together with the linear axis of motion of the drive element, encloses an angle of more than 45°.

5. A furniture drive element according to claim 4, wherein:

a) in a second end position of the displacing movement the longitudinal axis of the power transmission element is substantially parallel to the linear axis of motion of the drive element.

6. A furniture drive according to claim 1, wherein:

a) the drive element, which is linearly displaceable, is a spindle nut of a spindle drive, which is disposed non-rotatably and displaceably in the axial direction on a threaded spindle, which can be rotatably driven by an electric motor.

7. A furniture drive element according to claim 4, wherein:

a) in the first end position of displacing movement, the longitudinal axis of the power transmission element, together with the linear axis of motion of the drive element, encloses an angle of more than approximately 60°.

8. A furniture drive according to claim 1, wherein:

a) the position and distance of the coupling points of the power transmission element on the drive element and the pivot shaft are selected such that the power transmission element, during displacing movement, changes the angular position by more than 40°.

9. The furniture drive according to claim 1, wherein:

a) the crank pin of the pivot shaft guided along the power transmission element is guided in the slot.

* * * * *